US005608941A

United States Patent [19]

Kleinfeld

[11] Patent Number: 5,608,941

[45] Date of Patent: Mar. 11, 1997

[54] ROTARY BRUSH FOR DUCT-WORK CLEANING

[76] Inventor: James E. Kleinfeld, 4514 Perin La., Harrison, Ohio 45030

[21] Appl. No.: 428,020

[22] Filed: Apr. 25, 1995

[51] Int. Cl.[6] ..... F23J 3/02

[52] U.S. Cl. ..... 15/179; 15/186; 15/207.2; 15/383; 15/395

[58] Field of Search ..... 15/395, 383, 186, 15/179, 180, 176.2, 207.2

[56] References Cited

U.S. PATENT DOCUMENTS

| | | | |
|---|---|---|---|
| 431,526 | 7/1890 | Miller et al. . | |
| 1,831,416 | 12/1931 | Lecker . | |
| 1,869,730 | 8/1932 | Antle | 15/395 X |
| 1,970,302 | 8/1934 | Gerhardt . | |
| 2,102,178 | 12/1937 | Gerhardt . | |
| 2,167,949 | 8/1939 | Herold . | |
| 2,417,113 | 3/1947 | Kibbee . | |
| 2,654,905 | 10/1953 | Davis, Jr. . | |
| 2,974,932 | 3/1961 | Xenis | 15/186 X |
| 3,800,358 | 4/1974 | Ryan | 15/395 X |
| 3,878,580 | 4/1975 | Stohr et al. | 15/207.2 |
| 3,946,459 | 3/1976 | Armstrong | 15/395 X |
| 4,792,363 | 12/1988 | Franklin et al. | 15/395 X |
| 5,347,677 | 9/1994 | Prentice | 15/395 X |
| 5,405,450 | 4/1995 | Mifsud | 15/312.1 X |
| 5,438,729 | 8/1995 | Powell | 15/395 X |

*Primary Examiner*—Chris K. Moore
*Attorney, Agent, or Firm*—Charles R. Wilson

[57] ABSTRACT

A rotary brush is especially useful in vacuum cleaning of duct interiors. The brush has a hub with a center hole for receiving a drive shaft of a power tool, an annular collar positioned over the hub, and a low density strand set of polymeric flexible strands extending from the annular collar. The collar has a set of substantially uniformly spaced radial holes to receive the strands. The strand set of polymeric flexible strands is capable of being bent axially of the annular collar so as to access the duct's interior through a small opening. The strand set is also capable of bending radially during a cleaning process. The low density of strands ensures that efficient vacuuming of debris loosened by the rotary brush is accomplished.

15 Claims, 4 Drawing Sheets

ROTARY BRUSH FOR DUCT-WORK CLEANING

This invention relates to a rotary brush. More particularly, the invention relates to a rotary brush useful in vacuum cleaning of duct-work interiors.

BACKGROUND OF INVENTION

Duct-work is very prevalent in most residential and commercial establishments. It is used to convey heated air or cooled air from a central unit, e.g. a furnace or cooling coils. Duct-work is also used to convey air from individual rooms back to the central unit. Fumes from a generating source are conveyed by duct-work to the atmosphere or an air treating facility. For example, restaurants have hoods and duct-work to convey cooking fumes to the outside. Industrial establishments have duct-work for the above discussed air conditioning purposes as well as for the safe removal of gases and particulates from processing operations. Individual ducts, which collectively form the duct-work, can extend for several feet and can make one or more bends.

In most all instances, ducts eventually need to be cleaned inside. Various particulates accumulate over time. Those particulates can be dislodged and forced into a room to cause carpet, wall and fabric soiling. Bacteria can grow inside duct-work under certain conditions. This, of course, can pose a health concern.

Various means have been used to clean duct-work. Ideally, the duct-work is accessed at one spot and the full length of a duct cleaned in a single operation. Cleaning devices have been designed for this purpose. One commercially used device includes a cleaning head attached to a vacuum hose. The cleaning head has a power driven rotary brush. It is driven by a shaft which leads from a remote power source, through the vacuum hose and to the cleaning head. The cleaning head with its rotary brush and vacuum hose can be forced to travel through the duct-work, including around several bends. Necessarily, the shaft from the power source and the vacuum hose are flexible and can be forced around duct bends. The rotary brush on the cleaning head rotates as it moves through the duct-work. Debris is loosened and vacuumed away. The known devices have had limited success.

It has been found, however, that there are problems associated with known cleaning head systems of the type described above. Initially, it is difficult to gain access to the interior of some duct-works without having to cut an excessively large hole in one of the ducts. As readily imagined any hole must be able to accommodate the greatest cross dimension of the cleaning head, specifically the attached rotary brush. Additionally, the rotary brush and vacuum hose must work in concert. Any debris knocked loose by the brush must be immediately sucked into the vacuum hose before it settles back onto a wall of the duct. Proximate positioning of the rotary brush and vacuum hose end is important. However, known rotary brushes have a very dense set of bristles. The rotating bristles effectively block free access to the vacuum hose end.

There has now been developed a rotary brush which is useful in cleaning the interiors of duct-work. The brush solves many problems associated with known brushes for this particular use.

SUMMARY OF INVENTION

A rotary brush for duct cleaning purposes comprises a hub, an annular collar and a low density strand set of polymeric flexible strands. The hub has a center hole to receive a drive shaft from a power source. The annular collar is positioned over and secured to the hub. The collar has a set of substantially uniformly spaced radial holes extending through its wall to hold the polymeric flexible strands. The strands are capable of being bent axially as well as radially. A limited number of strands are found on the brush to ensure efficient operation of a vacuum means used with the brush. In use, the rotary brush is attached to the shaft of a power source. A vacuum means is operably associated with the rotary brush. As the rotary brush rotates, debris within the duct-work is loosened and drawn away by the vacuum means.

DETAILED DESCRIPTION OF THE INVENTION

The rotary brush of the invention is described with reference to the drawings and the following paragraphs. The rotary brush is especially useful for attachment to a mounting plate with associated power drive means and vacuum means for cleaning duct-work interiors. This preferred use is also described in detail. It should be understood the rotary brush is useful elsewhere and all such uses are contemplated.

Figure 1:
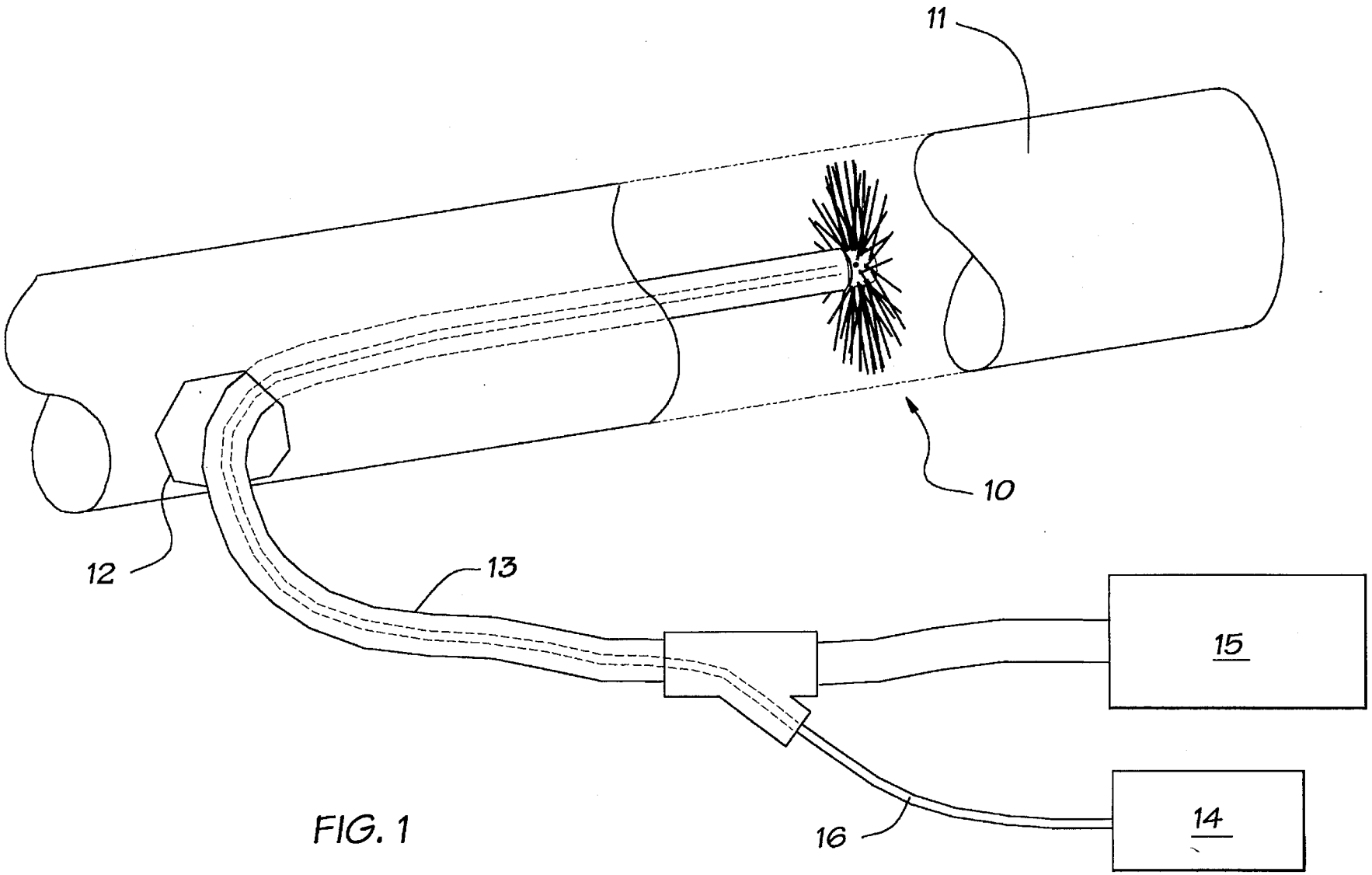
FIG. 1 is an environmental view showing the rotary brush of the invention in use.

The rotary brush 10 of the invention is shown in use in FIG. 1. Duct-work is found in many residential, commercial and industrial establishments. The duct 11 illustrated is used to convey warmed or cooled air from a central furnace or air cooling unit to individual rooms. Other ducts for the return of the air from the rooms back to the central unit and ducts used in commercial or industrial establishments are similar in nature. Suffice it to say, duct 11 is very typical. Its cross-sectional shape can be circular-shaped as shown or any other shape, e.g. square-shaped and rectangular-shaped.

Figure 2:
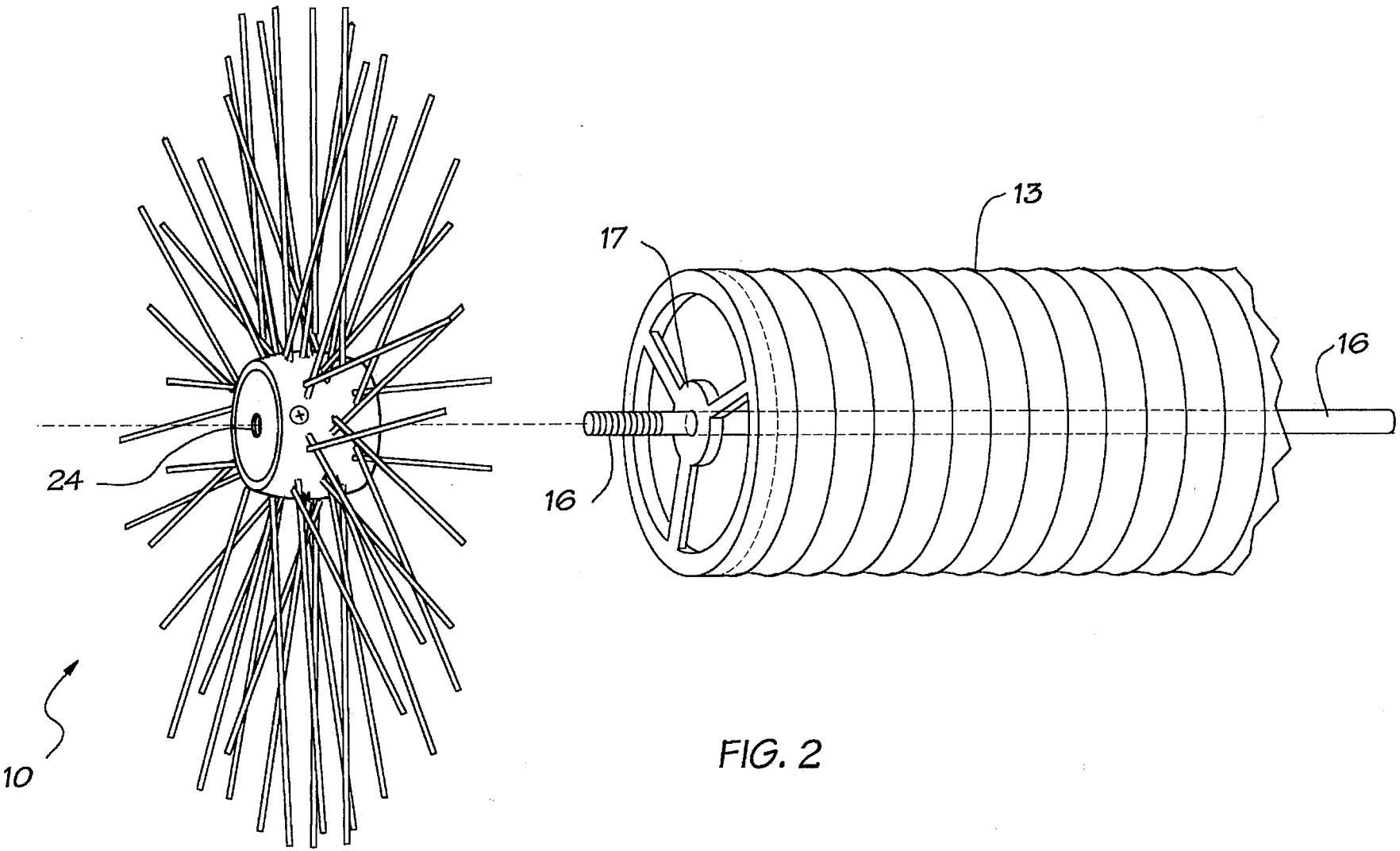
FIG. 2 is an exploded view in perspective of the rotary brush of the invention operably associated with a mounting plate and a drive shaft of a power tool.

As evident in FIG. 1, a small opening 12 has been cut into a wall of the duct 11 to access its interior. A flexible hose 13 is connected to a power source 14 and a vacuum means 15. The hose 13 extends into the opening 12 and leads to the rotary brush 10. The hose 13 is used to pull a vacuum and also to contain a flexible drive shaft 16. As best seen in FIG. 2, the rotary brush 10 is attachable to a mounting plate 17 secured to an end of the hose 13. The mounting plate 17 is configured to accommodate the rotary brush 10. It is also operably associated with the flexible hose 13 and the drive shaft 16 extending through the hose 13. The drive shaft 16 is driven by the power source 14. As apparent in FIG. 1, the flexible drive shaft 16 leads directly from the power source 14 to the mounting plate 17. In use, the shaft rotates to cause the brush to rotate. At the same time, a vacuum is drawn through the hose 13 so that any debris loosened by the rotary brush 10 is pulled into the hose 13. While not illustrated, it should be apparent that the flexible drive shaft could extend along the outside of the flexible hose and a mounting plate used which is configured for such an arrangement. The basic operation of the rotary brush of the invention remains the same.

With particular reference to FIGS. 3–6, the rotary brush comprises a hub 20, an annular collar 21 and a set of polymeric flexible strands 22. Each of these essential components of the brush is described in detail in the following paragraphs.

The hub 20 is a cylindrical-shaped member with at least one substantially flat side 23. As evident in FIG. 2, the flat side 23 abuts up against the mounting plate 17. A central hole 24 extends axially through the hub for the purpose of receiving the drive shaft 16. Preferably, the hole is internally threaded so as to secure the rotary brush to the threaded shaft. The drive shaft 16 can as well extend through the central hole 24 of the hub 20 and a nut threaded onto the drive shaft to secure them together.

The annular collar 21 is positioned over the hub 20 and permanently secured to it. The collar is dimensioned to preferably fully cover the circumferential wall of the hub. Its inside diameter is slightly larger then the outside diameter of the hub 20. As evident in FIGS. 5 and 6, individual strands 22 extend through a series of substantially uniformly spaced radial holes 25 in the collar's wall. For this reason, sufficient clearance must be provided between the hub and the annular collar to accommodate a portion of each strand. Optionally, screws 26 extend through the wall of the annular collar and into the hub to securely hold them together. Other attachment means such as rivets and adhesives can be used.

A low density strand set is needed for efficient operation of the rotary brush. Accordingly, the number of radial holes 25 in the annular collar is closely controlled. It has been found that from about five to about twenty holes per square inch of the collar's outer wall surface is preferred. More preferably, a total of from about seven to about fifteen radial holes per square inch are provided. Preferably, the radial holes are arranged in two to five substantially parallel row extending around the collar. More preferably, there are three substantially parallel rows of holes extending around the collar with the holes in the center line off-set from those in the two outside rows. In this more preferred hole arrangement, there are a total of from about six to about eight radial holes per square inch.

Figure 5:
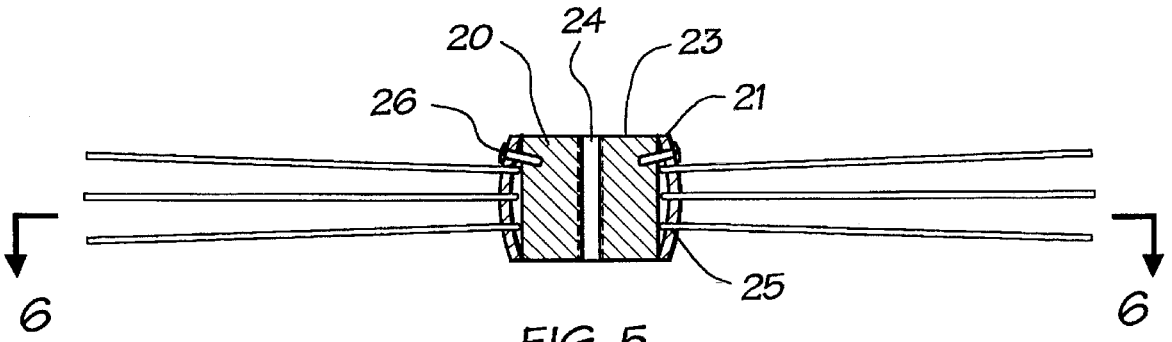
FIG. 5 is a side view in section of the rotary brush of FIG. 4 taken along line 5—5 thereof.
Figure 6:
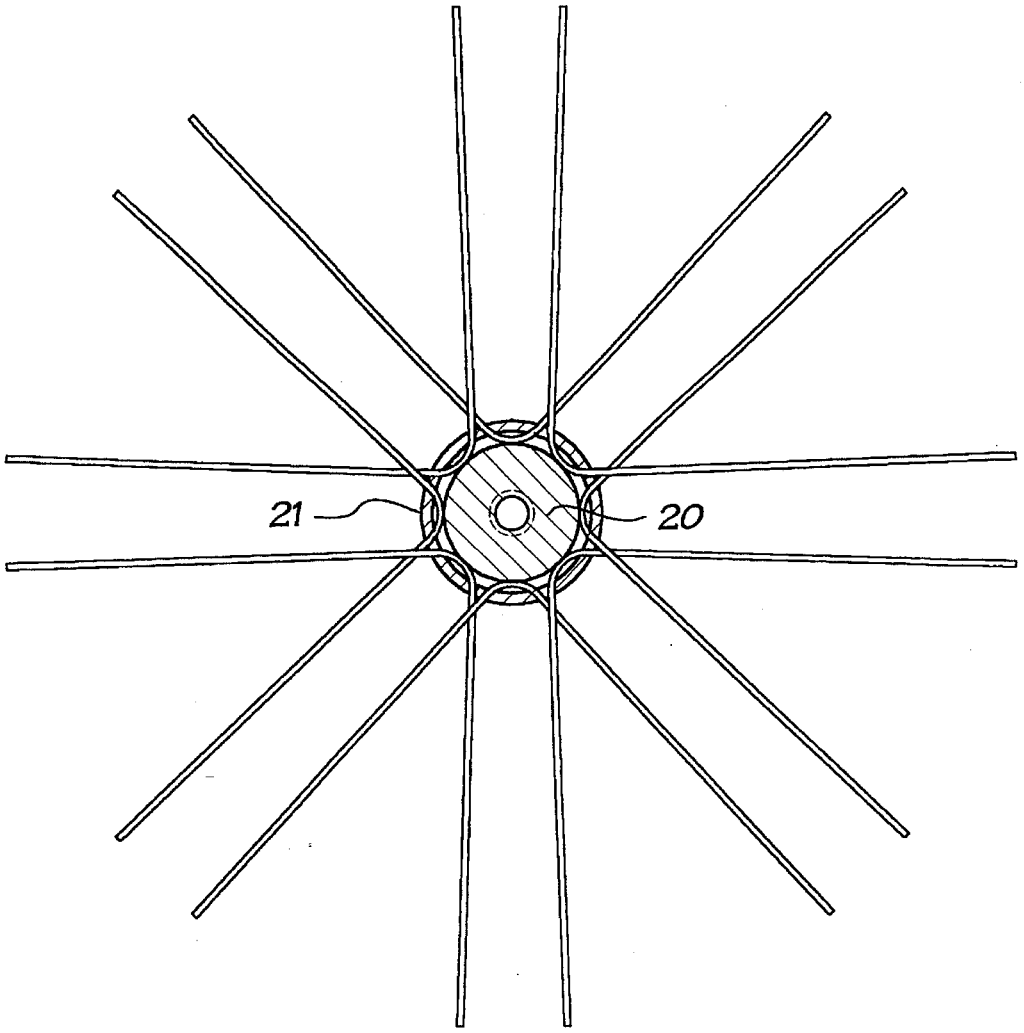
FIG. 6 is a top view in section of the rotary brush of FIG. 5 taken along line 6—6 thereof.

Each of the radial holes 25 of the annular collar 21 has a polymeric flexible strand extending outwardly. The strands are sufficiently flexible to bend axially while accessing a duct's interior as well as to bend radially during a cleaning operation. Preferably, the strands are made from about 0.075 mil to about 0.125 mil diameter polypropylene or nylon. Such materials are commercially available at a reasonable cost, are easy to clean, and, most importantly, are durable for the intended end-use. Each strand extends at least about two inches, and preferably, from about two inches to about twenty-four inches from the surface of the annular collar. As can be seen in FIG. 5, double length strands are preferably used. Each of these strands extends through a radial hole 25 and back through another radial hole 25. A force fit of the annular collar 21 with the strands properly positioned onto the hub 20 ensures that the strands remain in place.

Figure 3:
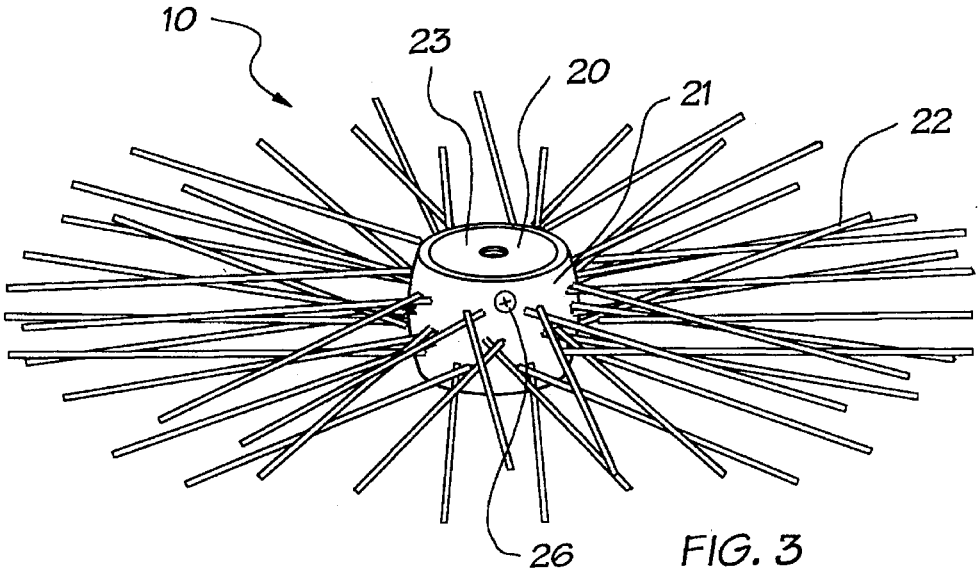
FIG. 3 is a perspective view of the rotary brush of FIG. 1.
Figure 4:
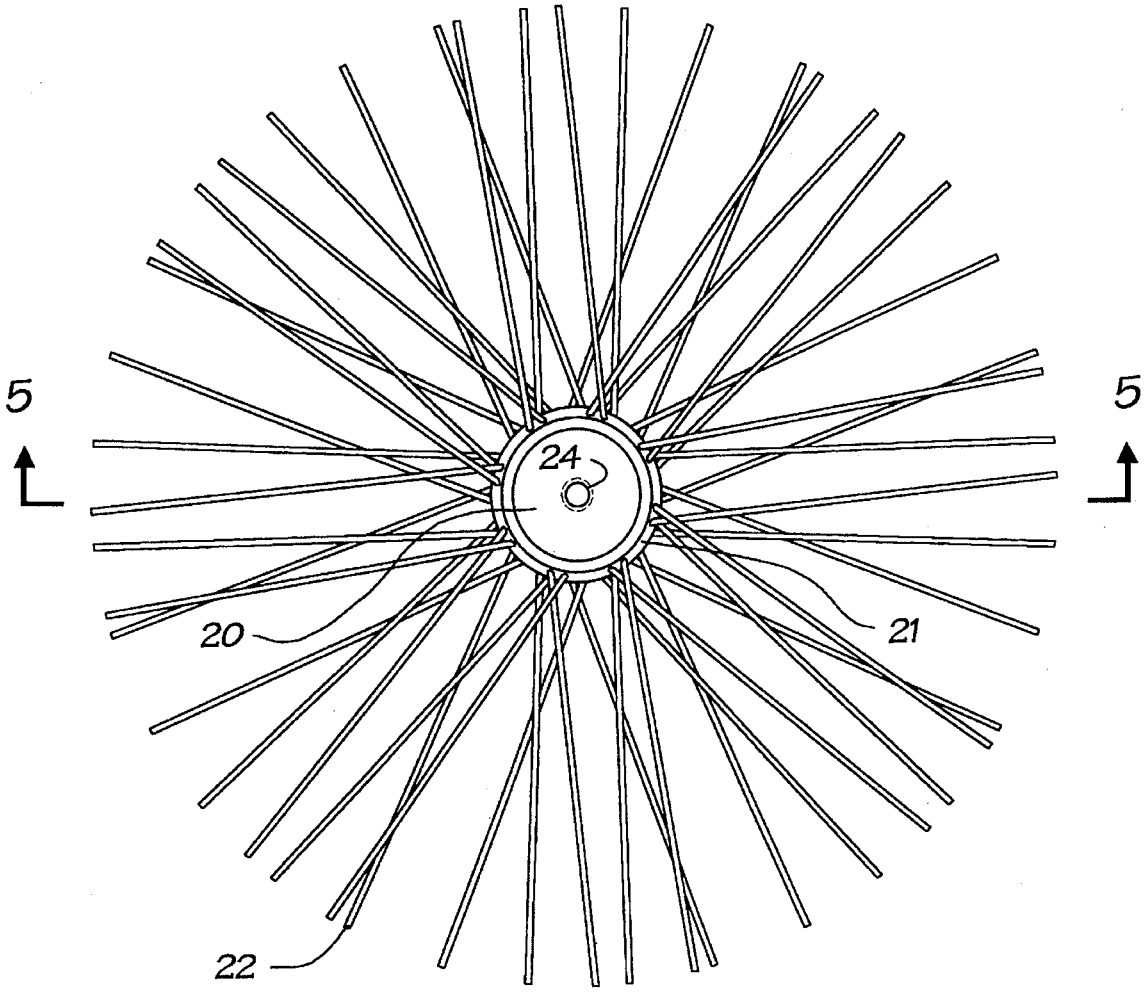
FIG. 4 is a top view of the rotary brush of FIG. 3.

With reference to FIGS. 3 and 4, the strand set of the rotary brush 10 has a low density of strands with substantial open space among the individual strands. As discussed below, the spaces are sufficiently open that at normal rotary brush speeds any debris which is loosened within the duct interior by the strands as they rotate can be vacuumed through the strands to reach the open end of the flexible hose.

In operation, the rotary brush of the invention is positioned on the mounting plate of the flexible hose. A terminal of the flexible drive shaft is inserted in the center hole of the rotary brush's hub and secured. The interior of the duct to be clean is next accessed by an outlet/inlet opening or by cutting a hole into a duct wall. In accord with the invention, the mounting plate with the rotary brush attached is forced into the duct. The strands of the brush are capable of bending axially to substantially reduce its maximum cross-dimension and consequently lessen the need for a large access hole. Once fully positioned in the duct, the rotary brush is caused to rotate at a prescribed speed and forced to move through the duct. The rotary brush is relatively light weight because of the low density strand set and, accordingly, is easy to manually push through the duct. A reduced power input is also a secondary benefit which flows from the light weight brush. Tips of the strands brush against the walls of the duct and loosen any debris. At the same time, a vacuum at the end of the flexible hose draws the loosened debris into the hose before it has a chance to resettle onto the duct walls. The rotary brush is durable and long lasting in part because of the polymeric strands not developing a bent or curved tip-set.

While the invention has been described in detail with particular reference to the drawings, it should be understood various modifications can be made. All such modifications of an obvious nature are considered within the scope of the appended claims.

I claim:

1. A debris loosening rotary brush for use in vacuum cleaning of duct interiors, said rotary brush comprising:

(a) a hub with a center hole for receiving a drive shaft of a power source;

(b) an annular collar positioned over the hub and secured thereto, said collar having a series of substantially uniformly spaced radial holes extending through its wall; and (c) a strand set of individual polymeric flexible strands extending outwardly from the radial holes of the annular collar wherein the polymeric flexible strands are capable of being bent axially of the annular collar so as to access the duct interior through a small opening and further wherein each polymeric flexible strand extends at least about two inches from the collar and spacing of the individual polymeric flexible strands is low density to facilitate vacuum removal through the strand set of debris loosened by the strands during use.

2. The debris loosening rotary brush of claim 1 wherein the annular collar has from about five to about twenty radial holes per square inch of outer wall surface.

3. The debris loosening rotary brush of claim 2 wherein the radial holes of the annular collar are arranged in two to five substantially parallel rows around a wall of the collar.

4. The debris loosening rotary brush of claim 3 wherein each polymeric flexible strand is made of polypropylene.

5. The debris loosening rotary brush of claim 3 wherein each polymeric flexible strand is made of nylon.

6. The debris loosening rotary brush of claim 1 wherein the center hole of the hub is internally threaded to receive a threaded drive shaft of the power source.

7. The debris loosening rotary brush of claim 1 wherein the annular collar has from about seven to about fifteen radial holes per square inch of the outer wall surface.

8. The debris loosening rotary brush of claim 7 further wherein the annular collar has three substantially parallel rows of radial holes extending through its wall.

9. The debris loosening rotary brush of claim 8 wherein the annular collar has from about six radial holes to about eight radial holes per square inch of outer wall surface.

10. A debris loosening rotary brush for use in vacuum cleaning of duct interiors, said rotary brush comprising:

(a) a cylindrical-shaped hub with a center hole for receiving a drive shaft of a power source;

(b) an annular collar positioned over the hub and secured thereto, said collar having from two to five substantially parallel rows of substantially uniformly spaced radial holes extending through its wall and wherein there are from about five to about twenty radial holes per square inch of outer wall surface; and (c) a strand set of individual polymeric flexible strands extending outwardly from the radial holes of the annular collar wherein the polymeric flexible strands are capable of being bent axially of the annular collar so as to access the duct interior through a small opening and further wherein each polymeric flexible strand extends from about two inches to about twenty-four inches in length from the collar and spacing of the individual polymeric flexible strands is low density to facilitate vacuum removal through the strand set of debris loosened by the strands during use.

11. The debris loosening rotary brush of claim 10 wherein the radial holes of the annular collar are arranged in three substantially parallel rows around a wall of the collar.

12. The debris loosening rotary brush of claim 11 wherein the annular collar has from about six to about eight radial holes per square inch.

13. The debris loosening rotary brush of claim 12 wherein each polymeric flexible strand is made of polypropylene.

14. The debris loosening rotary brush of claim 12 wherein each polymeric flexible strand is made of nylon.

15. The debris loosening rotary brush of claim 10 wherein the center hole of the hub is internally threaded to receive a threaded drive shaft of the power source.

* * * * *